United States Patent [19]

Zeigler

[11] 4,031,172

[45] June 21, 1977

[54] PROCESS FOR PREPARING NITROCELLULOSE FOR USE IN SMALL ARMS

[75] Inventor: Edward H. Zeigler, Cumberland, Md.

[73] Assignee: The United States of America as represented by the Secretary of the Army, Washington, D.C.

[22] Filed: Sept. 28, 1976

[21] Appl. No.: 727,555

Related U.S. Application Data

[63] Continuation of Ser. No. 544,529, Jan. 27, 1975.

[52] U.S. Cl. ..... 264/3 B; 264/3 E; 149/96; 149/97; 149/100

[51] Int. Cl.[2] ..... G21C 21/00

[58] Field of Search ..... 264/3 R, 3 B, 3 E; 149/96, 97, 100

[56] References Cited

UNITED STATES PATENTS

| | | | |
|---|---|---|---|
| 3,037,247 | 6/1962 | Preckel | 264/3 E X |
| 3,346,675 | 10/1967 | Sapiego | 264/3 E |
| 3,723,203 | 3/1973 | Craig et al. | 149/100 X |
| 3,855,373 | 12/1974 | Swotinsky et al. | 264/3 E X |
| 3,897,733 | 8/1975 | Stiefel et al. | 264/3 B X |
| 3,962,382 | 6/1976 | Johnson et al. | 264/3 E |

*Primary Examiner*—Peter A. Nelson

*Attorney, Agent, or Firm*—Nathan Edelberg; Robert P. Gibson; Arthur M. Suga

[57] ABSTRACT

An improved process for producing colloidal nitrocellulose having a high gravimetric loading density by a shock gel type process is provided. Process improvements result in part from the use of 13.35%N as the source of nitrocellulose and from the use of diethylene glycol monomethyl ether as the shock gel solvent. Gravimetric loading densities of at least 0.95 gm./ml. are achieved through this process.

5 Claims, No Drawings

PROCESS FOR PREPARING NITROCELLULOSE FOR USE IN SMALL ARMS

This is a continuation of application Ser. No. 544,529, filed Jan. 27, 1975.

This invention relates to an improved process for colloiding nitrocellulose for use in small areas. More particularly, this invention relates to an improved shock gel type process for colloiding nitrocellulose.

The shock gel process for colloiding nitrocellulose is disclosed in U.S. Pat. No. 3,037,247. In the shock gel process, fibrous nitrocellulose is first dissolved in a water-soluble solvent to form a nitrocellulose syrup. In a typical process, the syrup is forced through a perforated plate to form streams of syrup. The streams are permitted to fall through air whereby spherical droplets of syrup are formed. The droplets are introduced into a gelling bath containing an aqueous solution of a nitrocellulose solvent which solution is outside the solubility range of the nitrocellulose and therefore functions as a nonsolvent for the nitrocellulose. In the gelling bath the nitrocellulose precipitates out of solution almost instantaneously upon contact with the gelling bath solution forming a membrane in the shape of the droplet. Nitrocellulose syrup is trapped within the membrane. The solvent in the syrup diffuses into the gelling bath solution. As the concentration of solvent in the syrup is reduced, a gel structure of precipitated nitrocellulose is formed within the droplet.

The resulting nitrocellulose gels are then leached with water to exchange the solvent in the gels with water. The resulting water-wet gels are then dried. The gels shrink irreversibly during drying into dense balls of hard, horny nitrocellulose.

The shock gel process was principally developed for manufacture of double-base propellant from 12.6%N nitrocellulose. Attempts to utilize the process to manufacture a double-base gum propellant having a high loading density from nitrocellulose having a nitrogen content of greater than 13%N were initially unsuccessful. The nitrocellulose employed in this earlier work contained 13.2%N and was a blend of nitrocellulose of 12.6%N (nominal) and 13.35%N (minimum). This blend of nitrocellulose has been widely accepted in the past as particularly suitable for use in manufacture of smokeless powder. Although substantially completely colloided nitrocellulose was produced using 13.2%N nitrocellulose following the broad teachings of U.S. Pat. No. 3,037,427, the gravimetric loading density of the product produced was unsatisfactory for use in small arms. It was believed that failure to achieve a gravimetric loading density of at least 0.95 gm./ml. was principally the result of poor particle surfaces and shapes. These properties were thought to result, in part, from the differing solubilities of the nitrocellulose fractions in the blend of nitrocellulose being colloided in the shock gel solvent. Because of the difficulties in preparation of gun propellant having a high gravimetric loading density utilizing blends of nitrocellulose heretofore described, preparation of substantially fully colloided nitrocellulose utilizing a single grade of nitrocellulose containing 13.35%N (minimum) was investigated. As a result of this investigation, an improved shock gel type process was developed whereby it was possible to prepare gun propellant having a gravimetric loading density of at least 0.95 gm./ml. while minimizing processing costs utilizing a single grade of nitrocellulose containing 13.35%N. The improved process of this invention is particularly adaptable for continuous operation.

In accordance with this invention, a process is provided for preparing colloided nitrocellulose for use in small arms having a gravimetric loading density of at least 0.95 gm./ml., said process comprising the steps of (a) preparing a solution of nitrocellulose in diethylene glycol monomethyl ether, said nitrocellulose containing 13.35%N (minimum) and said solution comprising from about 5% to about 35% by weight of nitrocellulose, (b) forming said solution of nitrocellulose of step (a) into droplets, (c) introducing said droplets into a gelling bath comprising an aqueous solution of diethylene glycol monomethyl ether, said bath solution containing at the initial point of contact with the droplets from about 25% to about 50% by weight of water and from about 50% to about 75% by weight of diethylene glycol monomethyl ether, to rapidly gel the surface of the droplet so that no substantial distortion of the shape of the droplet occurs, (d) leaching the gelled in the presence of water until substantially all of the diethylene glycol monomethyl ether in the gelled droplet has been replaced by water, and (e) subjecting the resulting water-swollen gel to drying conditions to produce colloided nitrocellulose particles having a gravimetric loading density of at least 0.95 gm./ml.

The process of this invention is more fully described in the examples which follow. In the examples and throughout the specification, percentages are by weight unless otherwise specified.

EXAMPLE 1

Sixty pounds of nitrocellulose syrup was prepared by dissolving 5.75 pounds of nitrocellulose (13.4% nitrogen) containing 27% water in 54.25 pounds of diethylene glycol monomethyl ether, at a temperature of 140° F. An amount of 2-nitrodiphenylamine equivalent to 2% of the weight of the nitrocellulose (dry basis) was dissolved in the syrup. The resulting syrup consisted of 7% nitrocellulose, 2.58% water, 0.14% 2-nitrodiphenylamine, and 90.28% diethylene glycol monomethyl ether. The syrup had a viscosity of 3000 centipoises at a temperature of 144° F. The syrup was forced through a heated hose into a streaming head at a pressure of about 12 psig. The streaming head contained 90 orifices, each 0.0135 inch in diameter. The streaming head was suspended about 44 inches above a gelling bath. The streaming head was vibrated in the axial direction by an air powdered vibrator. The streams of nitrocellulose syrup issuing from the streaming head broke into droplets at an average distance of 14 inches from the streaming head. These droplets formed spheroids before impacting the gelling bath. A total of 40 pounds of syrup was forced through the streaming head in 70 minutes.

The gelling bath into which the nitrocellulose droplets were introduced contained about 760 pounds of an aqueous solution of 62% diethylene glycol monomethyl ether. The temperature of the bath was about 60° F. After streaming was stopped, the resulting nitrocellulose gels were drained free of excess liquid and were leached free of solvent in six batch leaching steps. The leaching liquid in the first leaching bath comprised about 20 gallons of an aqueous solution containing 40% diethylene glycol monomethyl ether. The residence time of the nitrocellulose gels in the leaching bath was about 10 minutes. The nitrocellulose gels were removed from the first bath and subsequently leached five successive times in baths each containing 20 gallons of deionized water. Residence time in each bath was about 10 minutes. There was no solvent in the liquid expressed from the gels after the final leaching step, based upon analysis of the liquids utilizing refractive index. After leaching, the gels contained 88.8% water and 11.2% nitrocellulose. The gels had a median particle size of 0.043 inch.

The leached, water-swollen gels were impregnated with nitroglycerin in aqueous solution in two steps in 140° F. Two hours were allowed for equilibrium in each step. The starting and ending nitroglycerin impregnation solution concentrations in Step 1 were 0.18% and 0.07%, respectively. For Step 2 the starting and end nitroglycerin impregnation solution concentrations were 0.17% and 0.11%, respectively. After nitroglycerin impregnation, the resulting double-base gels contained 73% water. The water-swollen double-base gels were dried to form double-base powder in a cylinder having a screen bottom through which air, preheated to 165°–175° F. was passed. Evaporation of water from the gels was sufficient to cool the air passing through the gel powder bed to 80°–90° F. except for the final portion of the drying cycle when the exit air temperature was allowed to rise to 150° F. After a total of 188 minutes drying time, the moisture content of the resulting double-base powder had been reduced to 0.3%.

Analysis of the dried double-base powder was as follows:

| | |
|---|---|
| Nitrocellulose | 87.08 |
| Extractables | |
| Nitroglycerin | 11.99 |
| 2-Nitrodiphenylamine | 0.43 |
| Water | 0.30 |
| Diethylene glycol monomethyl ether | 0.20 |

The median particle size of the dried, double-base powder was determined to be 0.0177 inch by screen analysis. The double-base powder was glazed with graphite to produce a coating of 0.3% by weight, based on the weight of the double-base powder. The gravimetric loading density of the glazed powder was then measured and it was 0.966 gm./ml.

Gravimetric loading density is measured by allowing a sample of powder to flow by gravity from a hopper into a receiver cup of calibrated volume. The receiver cup is allowed to overflow and the contents of the cup carefully leveled, avoiding settling of the contents in the cup. The weight of the powder is then determined and the gravimetric loading density is calculated by dividing the weight of the powder by the volume of the receiver. This method is set forth in MIL STD 286A (dated Aug. 18, 1961) method 502.1.1, and entitled "Bulk Density".

EXAMPLE 2

A two-hundred gram sample of the double-base powder prepared as above was given an 8% deterrent coating, a 0.3% graphite coating (glaze) and was subjected to ballistic testing in a 5.56mm cartridge. Results from this testing were compared to ballistics achieved utilizing ball powder having an authorized ballistic assessment value. Comparison of this data shows that the double-base powder prepared in accordance with this invention can be tailored to achieve ballistic performance acceptable for use in small arms and equivalent to or better than the performance of ball powder in small arms.

In the process of this invention, the nitrocellulose employed in Grade B gun cotton having a nitrogen content of 13.35%N (minimum) and conforming to U.S. Military Standard MIL-N-244A. The nitrocellulose can be used dry, water-wet, or wet with water and diethylene glycol monomethyl ether. Minimization of water in the nitrocellulose syrup is desirable as this leads to a syrup of lower viscosity. In the process of this invention, it is preferred to form a syrup of nitrocellulose in diethylene glycol monomethyl ether comprising from about 5% to about 35% by weight of nitrocellulose. Concentrations of nitrocellulose in the syrup of less than about 5% are not economical and gels from syrups of less than 5% nitrocellulose tend to be more fragile and readily distorted with resulting loading density degradation. As the concentration of nitrocellulose in the syrup increases, solution viscosity increases exponentially proportional to the third or fourth power of the concentration. Above about 35% nitrocellulose concentration, extraordinary processing methods are required to form solutions and droplets, and the process becomes uneconomical.

A nitrocellulose stabilizer such as ethyl centralite, 2-nitrodiphenylamine, or diphenylamine of the type commonly used is extruded smokeless powder is preferably added to and dissolved in the nitrocellulose syrup when the syrup is prepared.

The nitrocellulose syrup containing stabilizer is formed into spheroidal particles by forcing the syrup, by means of pressure, at a controlled rate through an orifice suspended over a gelling bath. The pressure may be produced by gravity head, a pump, or by compressed gas. The syrup issues from each orifice in the form of a small jet or stream which subsequently breaks up into droplets during free fall. Before entering the gelling bath, the falling droplets assume a configuration of minimum surface energy, i.e., a sphere or spheroid, because of external influences such as air drag. In practice, the distance the stream must fall before breaking up into droplets can be minimized by imparting vibrational energy to the stream in the axial direction by any suitable means, such as with a compressed air operated vibrator attached to the orifice plate.

The gel bath into which the nitrocellulose syrup droplets fall contains as aqueous solution of diethylene glycol monomethyl ether. This solvent can be present in the gel bath at any concentrations which cause gelation of the falling droplet. However, aqueous gelling solutions having a concentration of greater than 75% diethylene glycol monomethyl ether result in slow gelation of the droplet and produce a soft gel which in the early stages of gelation is susceptible to agglomeration and deformation. Gel baths containing aqueous solutions having a concentration of less than 50% diethylene glycol monomethyl ether result in fast gelation but produce gels of inferior density due to disruption of the gell network during diffusion of the solvent from the gel to the gelling bath. Low solvent concentration in the gel bath also results in heavier loads on the solvent recovery system with resultant extra recovery expense. In preferred practice, gel bath aqueous solutions are maintained at about 65% diethylene glycol monomethyl ether concentration to ensure fast gelation with little opportunity for deformation of the gel droplet while minimizing the amount of water which must be removed from the solvent prior to reuse.

Upon striking the surface of the gel bath solution, the gelation of the surface of the nitrocellulose droplets falling into the bath is so rapid that no substantial distortion of the shape of the droplet occurs. The gelled droplets are then exhaustively leached of solvent by bringing them into intimate contact with solutions containing progressively less solvent than the solvent concentration in the gelling bath until the gels contain only nitrocellulose, a nitrocellulose stabilizer and water. During leaching, solvent in the syrup is exchanged for water until the droplets contain substantially a water-nitrocellulose gel. Leaching is important also for the purpose of solvent recovery in order to make the overall process economical. Leaching is important to reduce solvent losses which must be replaced with new solvent.

To form a single-base powder, i.e., one containing no explosive plasticizer, the water-swollen shock gels are subjected to some form of drying treatment. As the water leaves the gels under the conditions of drying, the gels shrink irreversibly to yield a solid sphere or spheroid of completely colloided nitrocellulose and stabilizer, i.e., a single-base powder.

More typically, the water-swollen shock gels are converted into a double-base powder. The gels, leached free of residual solvent, are impregnated with an explosive plasticizer such as nitroglycerin. The water-swollen gels can be impregnated with nitroglycerin with either an emulsion technique or a solution technique. In the emulsion technique, the gels are contacted with an emulsion of nitroglycerin in water. An emulsifying agent such as methyl cellulose at a low concentration (0.2–2.0%) is necessary to ensure a stable emulsion. The tiny droplets of nitroglycerin contact the gels and diffuse into the gels until the required amount of nitroglycerin is absorbed. The advantage of this technique is the high ratio of nitroglycerin to water which can be employed. The disadvantages of this technique are the presence of undiluted nitoroglycerin and the occurrence of loading density degradation of the finished powder due to localized surface distortion which occurs at the point of contact between nitroglycerin droplet and gels.

The preferred technique of nitroglycerin impregnation is contant of the water-swollen gels with a solution of nitroglyceri in water. The advantages of the solution impregnation technique are the lock of loading density degradation due to uniform absorption from a true solution and the inherent safety of the very dilute nitroglycerin solution (about 0.2% at 140° F. represents saturation). The only disadvantage is the very large volume of solution with which a given mass of water-swollen gels must be contacted to achieve a particular nitroglycerin level.

In the solution method, drained, water-swollen gels are immersed in a solution of nitroglycerin dissolved in water at 140° F. The nitroglycerin is initially present at a concentration of about 0.2% (very close to saturation at this temperature). After two hours of impregnation, the gels have absorbed a portion of the nitroglycerin from the impregnating both and are in equilibrium with the remaining nitroglycerin. The impregnated gels may now be transferred to a second bath whose initial concentration is chosen so that equilibrium between the gels and the solution occurs at a concentration that corresponds to the desired final nitroglycerin concentration in the gel. If desired, the impregnation may be performed in a single step requiring only that a large enough volume of nitroglycerin/water solution be available.

The gels, now consisting of nitrocellulose, stabilizer, nitroglycerin and water, are dried to produce a double-base smokeless powder. Drying may be carried out in most types of dryers suitable for explosive materials. A preferred method for rapid drying is one in which a stream of heated air blows through a bed of gels at such a velocity as to cause them to become fluidized. As water leaves the particles, they irreversibly shrink to become completely colloided, dense particles of double-base powder.

This double-base shock gel powder is deterrent coated by the use of conventional techniques and materials to alter ballistic properties and make it suitable for the particular cartridge for which it is intended.

The coated powder, after drying, is glazed with a small amount of graphite in order to reduce its sensitivity to initiation by static electricity and to improve its flow characteristics.

What I claim and desire to protect by Letters Patent is:

1. A process for preparting colloided nitrocellulose for use in small arms having a gravimetric loading density of at least 0.95 gm/ml., said process comprising, a. preparing a syrup of nitrocellulose in diethylene glycol monomethyl ether, said nitrocellulose containing 13.35%N (minimum) and said syrup comprising from about 5% to about 35% by weight of nitrocellulose, b. adjusting viscoty of said syrup to about 3000 centipoises, c. forcing said viscosity-adjusted syrup under sufficient pressure into a streaming head containing about 90 orifices to extrude through said orifixs, each of said orifices being about 0.0135 inch in diameter, d. vibrating said streaming head while said pressurized syrup is flowing therethrough to form falling droplets of said syrup about 14 inches below said streaming head, said vibrations being imparted to said streaming head in a direction parallel to the gravitational path of said falling droplets, e. introducing said droplets into a gelling bath comprising an aqueous solution of diethylene glycol monomethyl ether, said bath solution containing at the initial point of contact with the droplets from about 30% to about 50% by weight of water and from about 50% to about 70% by weight of diethylene glycol monomethyl ether to rapidly gel the surface of the droplet so that no substantial distortion of the droplet occurs, f. leaching the gelled droplet in the presence of water until substantially all of the diethylene glycol monomethyl ether in the gelled droplet has been replaced by water, and g. subjecting the resulting water-swollen gel to drying conditions to produce a colloided nitrocellulose having a gravimetric loading density of at least 0.95 gm/ml.

2. The process of claim 1 in which the water-swollen gels are contacted with an aqueous emulsion of nitroglycerin and the resulting plasticized gels are subjected to drying conditions to remove residual water and produce a double-base nitrocellulose composition.

3. The process of claim 1 in which the water-swollen gels are contacted with an aqueous solution of nitroglycerin and the resulting plasticized gels are subjected to drying conditions to remove residual water and to produce a double-base nitrocellulose composition.

4. The process of claim 1 wherein said droplets fromed after the leaching step (f) has a median particle size of about 0.043 inch.

5. The process of claim 3 wherein said dried double-base nitrocellulose has a median particle size of about 0.02 inch.

* * * * *